US009299245B2

(12) United States Patent
Vartiainen et al.

(10) Patent No.: US 9,299,245 B2
(45) Date of Patent: Mar. 29, 2016

(54) GUIDING A USER TO SAFETY FROM THE PREMISES OF AN INDUSTRIAL PLANT

(75) Inventors: Elina Vartiainen, Västerås (SE); Martin Olausson, Västerås (SE); Jonas Brönmark, Västerås (SE)

(73) Assignee: ABB RESEARCH LTD, Zürich (CH)

( * ) Notice: Subject to any disclaimer, the term of this patent is extended or adjusted under 35 U.S.C. 154(b) by 0 days.

(21) Appl. No.: 14/403,442

(22) PCT Filed: May 25, 2012

(86) PCT No.: PCT/EP2012/059820
§ 371 (c)(1),
(2), (4) Date: Nov. 24, 2014

(87) PCT Pub. No.: WO2013/174441
PCT Pub. Date: Nov. 28, 2013

(65) Prior Publication Data

US 2015/0102936 A1 Apr. 16, 2015

(51) Int. Cl.
*G08B 27/00* (2006.01)
*G08B 7/06* (2006.01)

(52) U.S. Cl.
CPC ..... *G08B 27/005* (2013.01); *G08B 7/066* (2013.01); *G08B 27/006* (2013.01)

(58) Field of Classification Search
CPC ..... G08B 7/066; G08B 27/005; G08B 27/006
USPC ..... 340/691.6; 455/404.2
See application file for complete search history.

(56) References Cited

U.S. PATENT DOCUMENTS

| | | | | |
|---|---|---|---|---|
| 7,398,097 | B2 * | 7/2008 | Parkulo | G08B 25/016 340/501 |
| 8,094,038 | B2 * | 1/2012 | Nguyen et al. | 340/686.1 |
| 8,145,183 | B2 | 3/2012 | Barbeau et al. | |
| 2001/0050612 | A1 | 12/2001 | Shaffer | |
| 2003/0162557 | A1 * | 8/2003 | Shida | 455/521 |
| 2007/0049259 | A1 * | 3/2007 | Onishi et al. | 455/414.2 |
| 2007/0194922 | A1 | 8/2007 | Nathan et al. | |
| 2011/0183644 | A1 * | 7/2011 | Gupta | 455/404.2 |
| 2012/0302197 | A1 * | 11/2012 | Koontz et al. | 455/404.2 |

(Continued)

FOREIGN PATENT DOCUMENTS

| | | | |
|---|---|---|---|
| CN | 101027700 | A | 8/2007 |
| CN | 101681541 | A | 3/2010 |
| JP | 2010-160539 | A | 7/2010 |
| JP | 2010-244407 | A | 10/2010 |

(Continued)

*Primary Examiner* — Jennifer Mehmood
*Assistant Examiner* — Omar Casillashernandez
(74) *Attorney, Agent, or Firm* — Birch, Stewart, Kolasch & Birch, LLP

(57) ABSTRACT

A method, safety route guiding device and a computer program product enables users in the premises of an industrial plant to reach safety in case of an emergency, where said users are equipped with mobile terminals, where the safety route guiding device includes a guiding unit that receives alarm data concerning an emergency in a clearance zone of the premises, the alarm data being relevant for a user of a mobile terminal, obtains data of a set of other users affected by the emergency, guides the user from the clearance zone to a security zone outside the premises, obtains status data concerning the other users in the set, and presents the status data to the user via the mobile terminal.

20 Claims, 6 Drawing Sheets

(56) References Cited

U.S. PATENT DOCUMENTS

| | | | | |
|---|---|---|---|---|
| 2013/0036175 | A1* | 2/2013 | Lau | G08B 27/001 709/206 |
| 2013/0103309 | A1* | 4/2013 | Cai et al. | 701/515 |

FOREIGN PATENT DOCUMENTS

| | | | |
|---|---|---|---|
| KR | 10-2004-0106802 | A | 12/2004 |
| WO | WO 2008/133915 | A1 | 11/2008 |
| WO | WO 2009/085873 | A1 | 7/2009 |

* cited by examiner

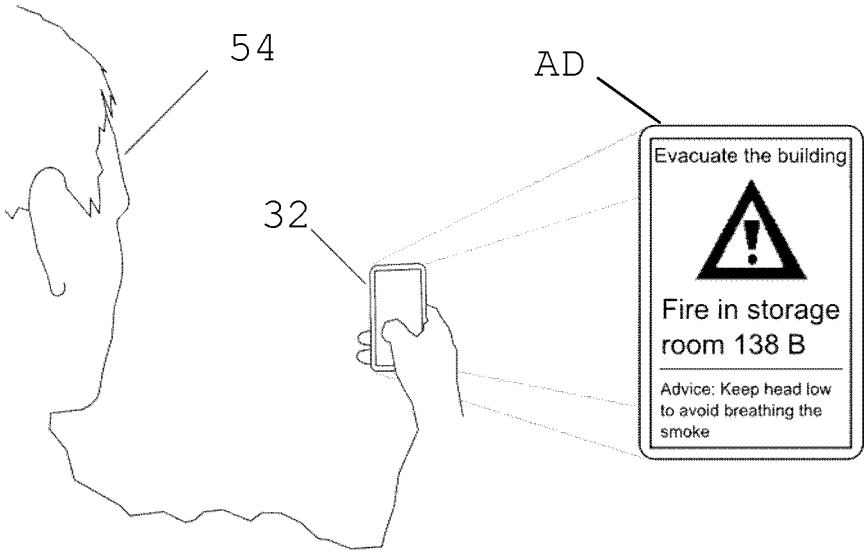
FIG. 5
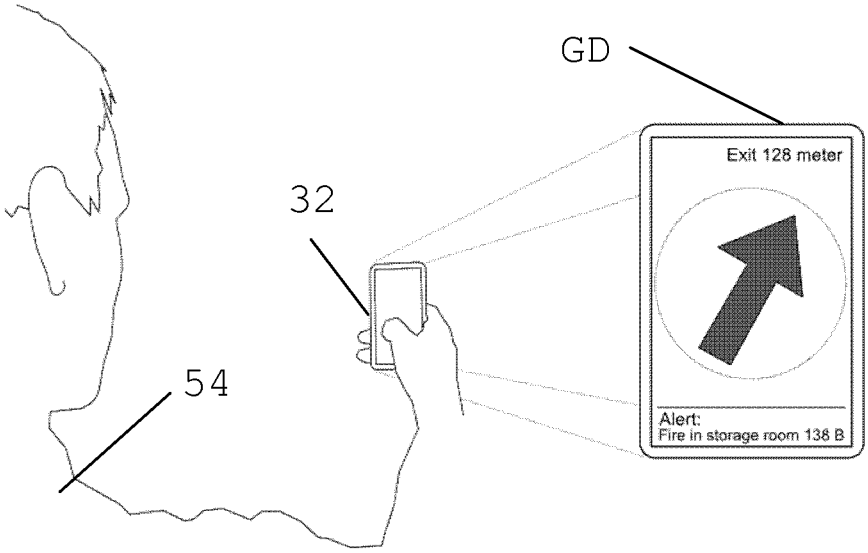
FIG. 6
FIG. 11
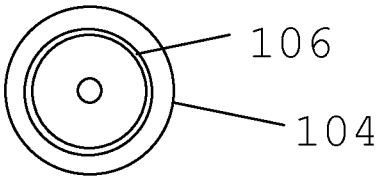

GUIDING A USER TO SAFETY FROM THE PREMISES OF AN INDUSTRIAL PLANT

FIELD OF THE INVENTION

The present invention generally relates to industrial plants. More particularly the present invention relates to a method, safety route guiding device and a computer program product enabling users in the premises of an industrial plant to reach safety in case of an emergency.

BACKGROUND

In the facilities of industrial plants there may occur situations where system users need to be evacuated.

It is for instance possible that some kind of industrial process is performed in the premises, which involves steps that may cause an emergency in exceptional circumstances. This is for instance the case if the process is a chemical process with unwanted chemical reactions. However emergencies may occur also for other reasons such as a machine overheating and starting to burn.

If an emergency occurs it is of importance that the operators at the location where the emergency occurred are able to leave the premises. This may in some situations be hard. The route to safety may be complicated. The users may furthermore panic and may then not be able to digest too complicated instructions.

Guiding of users to safety using mobile terminals has previously been suggested in other areas.

WO 2009/085873, US 2007/049259, KR 20040106802, JP 201024407 and U.S. Pat. No. 8,145,183 all describe various ways to guide users to safety using mobile terminals in relation to public or semi-public areas.

However, there is still a need for improvement of such guidance, especially in relation to industrial plants.

The present invention addresses one or more of the above motioned problems.

SUMMARY OF THE INVENTION

The present invention addresses this situation. The invention is therefore directed towards solving the problem of providing an improved guiding of users of an industrial plant to safety in the case of an emergency.

This object is according to a first aspect of the invention solved through a method of enabling users in the premises of an industrial plant to reach safety in case of an emergency, where the users are equipped with mobile terminals, the method being performed by a safety route guiding device and comprising the steps of:

- receiving alarm data concerning an emergency in a clearance zone of the premises, the alarm data being relevant for a user of a mobile terminal,
- obtaining data of a set of other users affected by the emergency,
- guiding the user from the clearance zone to a security zone outside the premises,
- obtaining status data concerning the other users in the set, and
- presenting the status data to the user via the mobile terminal.

This object is according to a second aspect of the invention solved through a safety route guiding device enabling users in the premises of an industrial plant to reach safety in case of an emergency, where said users are equipped with mobile terminals the safety route guiding device being configured to:

- receive alarm data concerning an emergency in a clearance zone of the premises, the alarm data being relevant for a user of a mobile terminal,
- obtain data of a set of other users affected by the emergency,
- guide the user from the clearance zone to a security zone outside the premises,
- obtain status data concerning the other users in the set, and
- present the status data to the user via the mobile terminal.

This object is according to a third aspect of the invention solved through a computer program product enabling users in the premises of an industrial plant to reach safety in case of an emergency, where said users are being equipped with mobile terminals, the computer program product being provided on a data carrier comprising computer program code configured to cause a safety route guiding device to, when said computer program code is loaded into the safety route guiding device,

- receive alarm data concerning an emergency in a clearance zone of the premises, said alarm data being relevant for a user of a mobile terminal,
- obtain data of a set of other users affected by the emergency,
- guide the user from the clearance zone to a security zone outside the premises,
- obtain status data concerning the other users in the set, and
- present the status data to the user via the mobile terminal.

The present invention has a number of advantages. It guides a user in an industrial plant to safety in an efficient way. It also allows identifying of personnel that are unable to reach safety themselves to be located. It is in this way possible to send help to them and to plot their positions on a map in order to send backup.

BRIEF DESCRIPTION OF THE DRAWINGS

The present invention will in the following be described with reference being made to the accompanying drawings, where FIG. 1 schematically shows an industrial plant with a process control system 10 operating an industrial process together with a number of mobile terminals associated with plant operators, FIG. 2 schematically shows a front view of a mobile terminal, FIG. 3 schematically shows a block schematic of the mobile terminal.

DETAILED DESCRIPTION OF THE INVENTION

In the following, a detailed description of preferred embodiments of a method, an operator terminal and a computer program product for enabling an operator to make control related decisions in a process control system.

Figure 1:
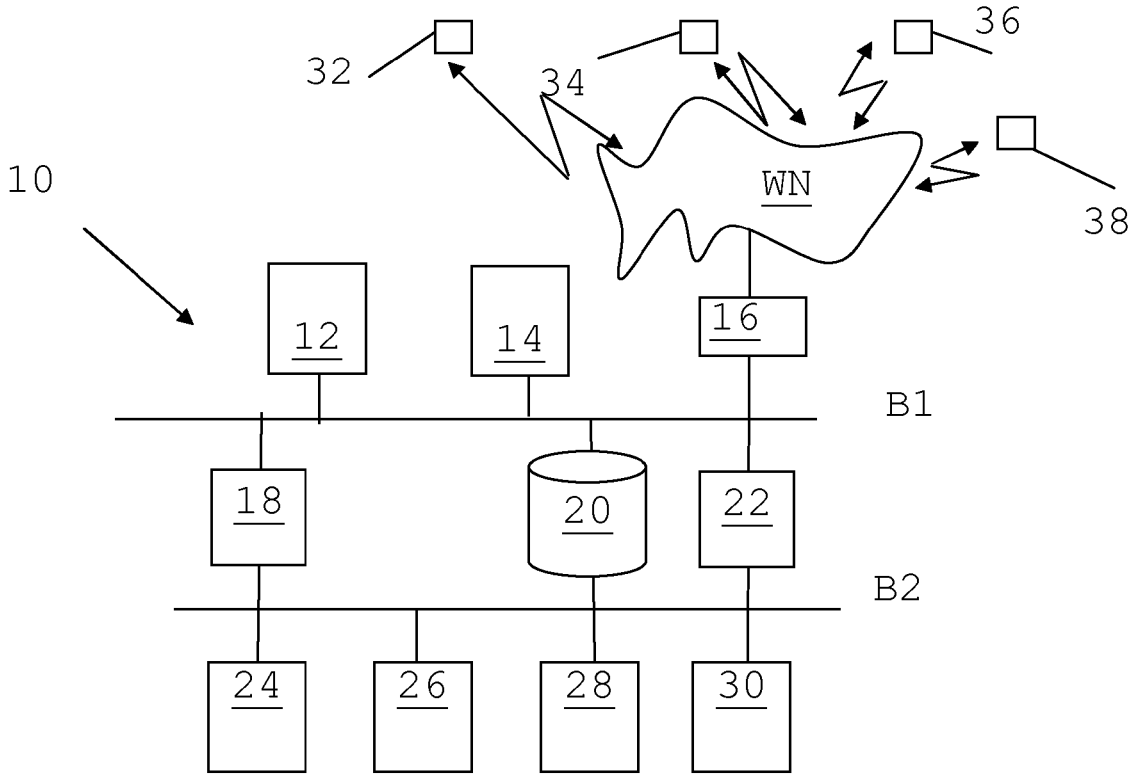

FIG. 1 schematically shows an industrial plant 10 where a process control system is provided. The process control system is a computerized process control system for controlling an industrial process. The process can be any type of industrial process, such as electrical power generation, transmission and distribution processes as well as water purification and distribution processes, oil and gas production and distribution processes, petrochemical, chemical, pharmaceutical and food processes, and pulp and paper production processes. These are just some examples of processes where the system can be applied. There exist countless other industrial processes. The process may also be other types of industrial processes such as the manufacturing of goods. The process may be monitored through one or more process monitoring computers, which communicate with a server handling monitoring and control of the process.

In FIG. 1 the process control system therefore includes a number of process monitoring computers 12 and 14. These computers may here also be considered to form operator terminals and are connected to a first data bus B1. There is also a gateway 16 connected to this first data bus, which gateway 16 is connected to at least one wireless network WN. To the wireless network WN there is connected a first, second, third and fourth mobile terminal 32, 34, 36 and 38. The wireless network WN may be a local network, such as wireless local area network (WLAN). It may also be a Bluetooth network, i.e. a network with a number of interconnected Bluetooth nodes. In some variations of the invention the mobile terminals are dual mode terminals able to communicate with both a Bluetooth or WLAN network as well as with a mobile communication network, such as public land mobile communication network (PLMN).

There is furthermore a second data bus B2 and between the first and second data busses B1 and B2 there are connected a server 18 providing control and protection of the process and a database 20 where data relating to control and protection of the process is stored. Such data relating to control and protection may here comprise process control data such as measurements and control commands, while data relating to protection may comprise alarm and event data as well as data on which alarms and events can be generated, such as measurements made in the process. There is furthermore a guiding server 22 connected between the two buses B1 and B2, This guiding server 22 may in one variation of the invention provide a safety route guiding device. In other variations of the invention it provides data to the mobile terminals in order to enable them to act as safety route guiding devices.

To the second data bus B2 there is furthermore connected a number of further devices 24, 26, 28 and 30. A first of these further devices is a sensor 24. The other further devices 26, 28 and 30 are field devices, which are devices that are interfaces to the process being controlled. A field device is typically an interface via which measurements of the process are being made and to which control commands are given. One or more of these field devices may furthermore be able to generate alarms. The sensor 24 may also be a field device. However it is not necessarily a field device. It can thus sense something else than properties of the process, such as if there is something generally wrong in the environment of the process. This sensor 24 may thus be sensing a property of the process or sensing some general environmental safety parameters such as the temperature of a room or a container. The sensor 24 may in case it is a field device then send an alarm to the server 18 if there is an accident in the industrial process. In one variation of the invention the sensor 24 reports alarms to the guiding server 22. As will be seen later, the sensor 24 may have a direct connection to the local wireless network WN in which case it may report alarms directly to the mobile terminals 32, 34, 36 and 38. It should here be realized that the description given above that the guiding server 22 and possibly also the sensor 24 are not necessarily connected to the process control system.

Figure 2:
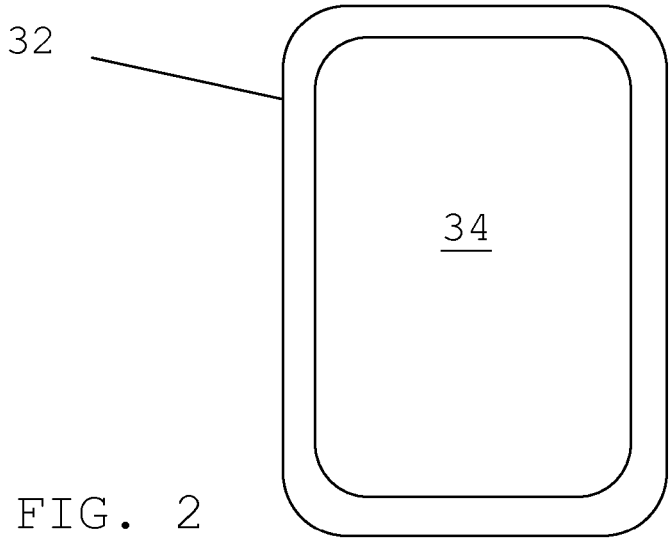

FIG. 2 schematically shows a front view of the first mobile terminal 32. It simply comprises a display 34. The display 34 is in some variations of the invention a touch screen via which data can be presented for the user of the mobile terminal 32 as well as via which data can be entered by the user, such as selections of various features in applications. It should be realized that in other variations of the invention the display may only be a display and the inputs provided through a keypad or a keyboard, a trackball, a joystick or some other buttons.

Figure 3:
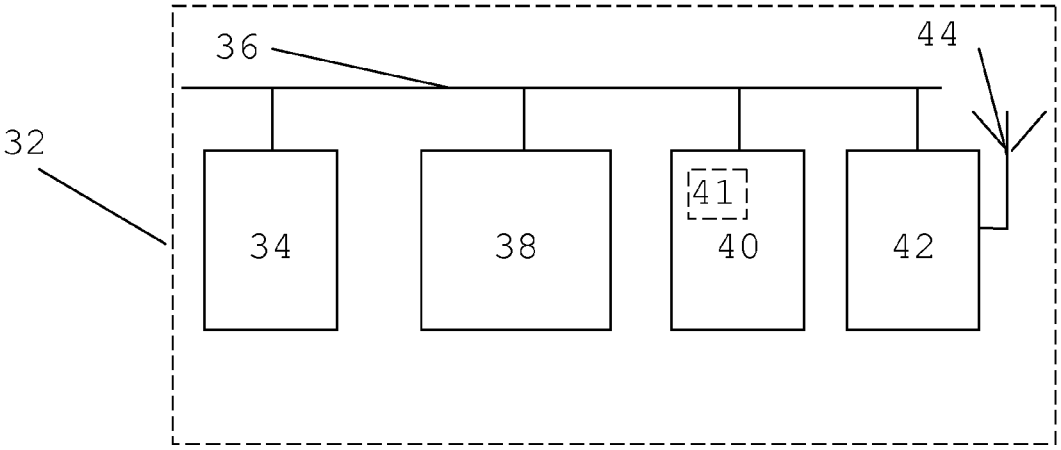

FIG. 3 shows a block schematic of the first mobile terminal 32. The first mobile terminal 32 comprises a bus 36 and to this bus there is connected the display 34, a processor 38, a program memory 40 as well as a radio communication circuit 42. The radio communication circuit 42 is furthermore connected to an antenna 44 for wireless communication with the wireless network WN. It should here be realized that the first mobile terminal may also comprise a second radio circuit and a second antenna for communicating with a mobile communication network. In the program memory there is provided software code which when being run by the processor forms a guiding unit 41. In some embodiments of the invention the guiding unit 41 is merely a slave unit reporting data to the server 22, which server then forms a safety route guiding device. In other variations the guiding unit 41 is a safety route guiding device, which receives data from the guiding server 22 regarding alarms and other users. It then performs the guiding activities of the route guiding device based on this data. In other variations of the invention the route guiding unit forming the safety route guiding device does not communicate with any guiding server. Instead it receives such data directly from the sensor and the other mobile terminals via the local wireless network WN.

Figure 4:
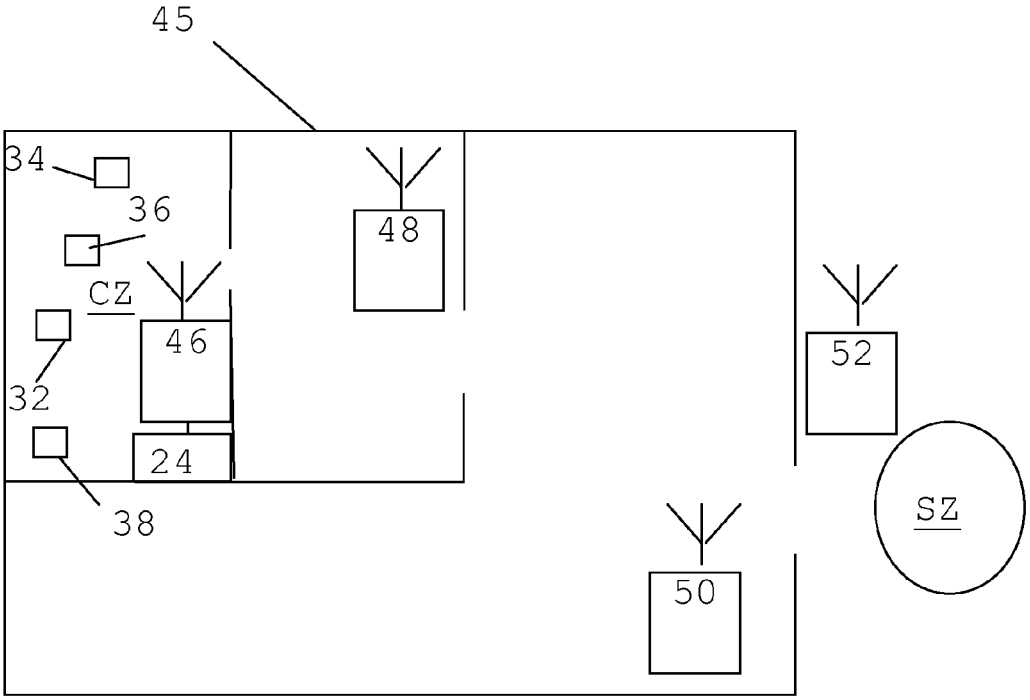
FIG. 4 shows premises of the industrial plant with a number of rooms and a number of mobile terminals, where there is a clearance zone in a first room and a security zone outside of the premises, FIG. 5 schematically shows a first view shown on the display of the mobile terminal, FIG. 6 schematically shows a second view shown on the display of the mobile terminal, FIG. 7 schematically shows a third view shown on the display of the mobile terminal, FIG. 8 schematically shows a fourth view shown on the display of the mobile terminal.

FIG. 4 schematically shows a facility 45 of the industrial plant. The facility 45 is here in the form of a building with a number of rooms. There is here a first room where there is a first wireless access point 46 of the wireless network. This first wireless access point 46 is connected to the sensor 24, which is thus also located in the first room. In this figure also the first, second, third and fourth mobile terminals 32, 34, 36 and 38 are located in the first room, which indicates that also the corresponding users are in this first room. Next to the first room there is a second room with a second wireless access point 48. The second room in turn leads to a third larger room with a third wireless access point 50. In the third room there is a door leading out of the premises 45 and outside of the premises there is a fifth wireless access point 52 of the wireless network. All the access points 46, 48, 50 and 52 are here furthermore located close to doors leading to or from the rooms. The first wireless access point 46 is therefore provided close to a door interconnecting the first and the second rooms, the second wireless access point 48 is located close to a door interconnecting the second and the third rooms and the third wireless access point 50 is provided close to the door leading out of the building 45. Also the fifth wireless access point 52 is placed close to this latter door, however on the outside of the building 45. The above described access point positions close to doors are advantageous in that they simplify the giving of guiding instructions. However the invention is in no way limited to these positions. Other may thus be used.

The first room is here shown as being a clearance zone CZ and an area outside of the building 45 is shown as being a security zone SZ.

Furthermore the positions of the wireless access points 46, 48, 50 and 52 are typically known and because of this also the positions of the mobile terminals and consequently the users may be known.

Figure 7:
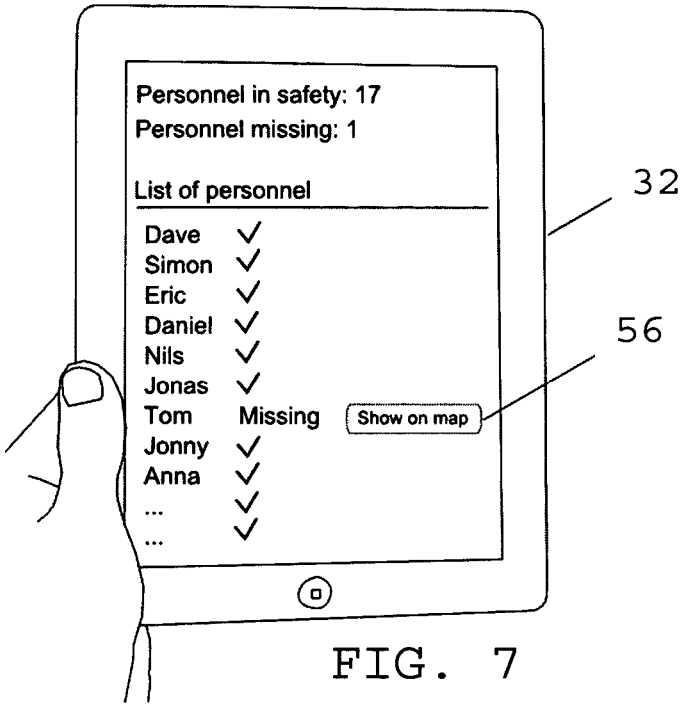
Figure 8:
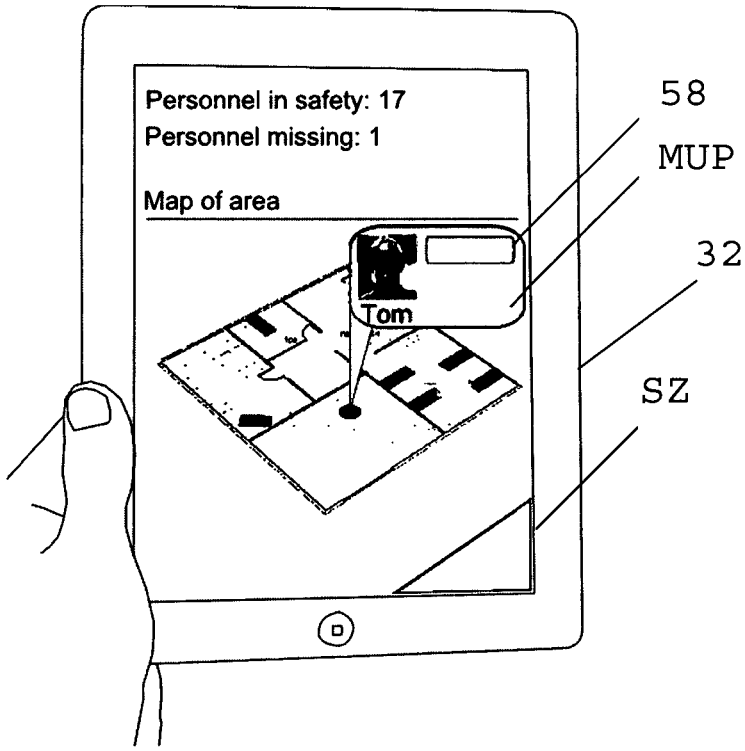
Figure 9:
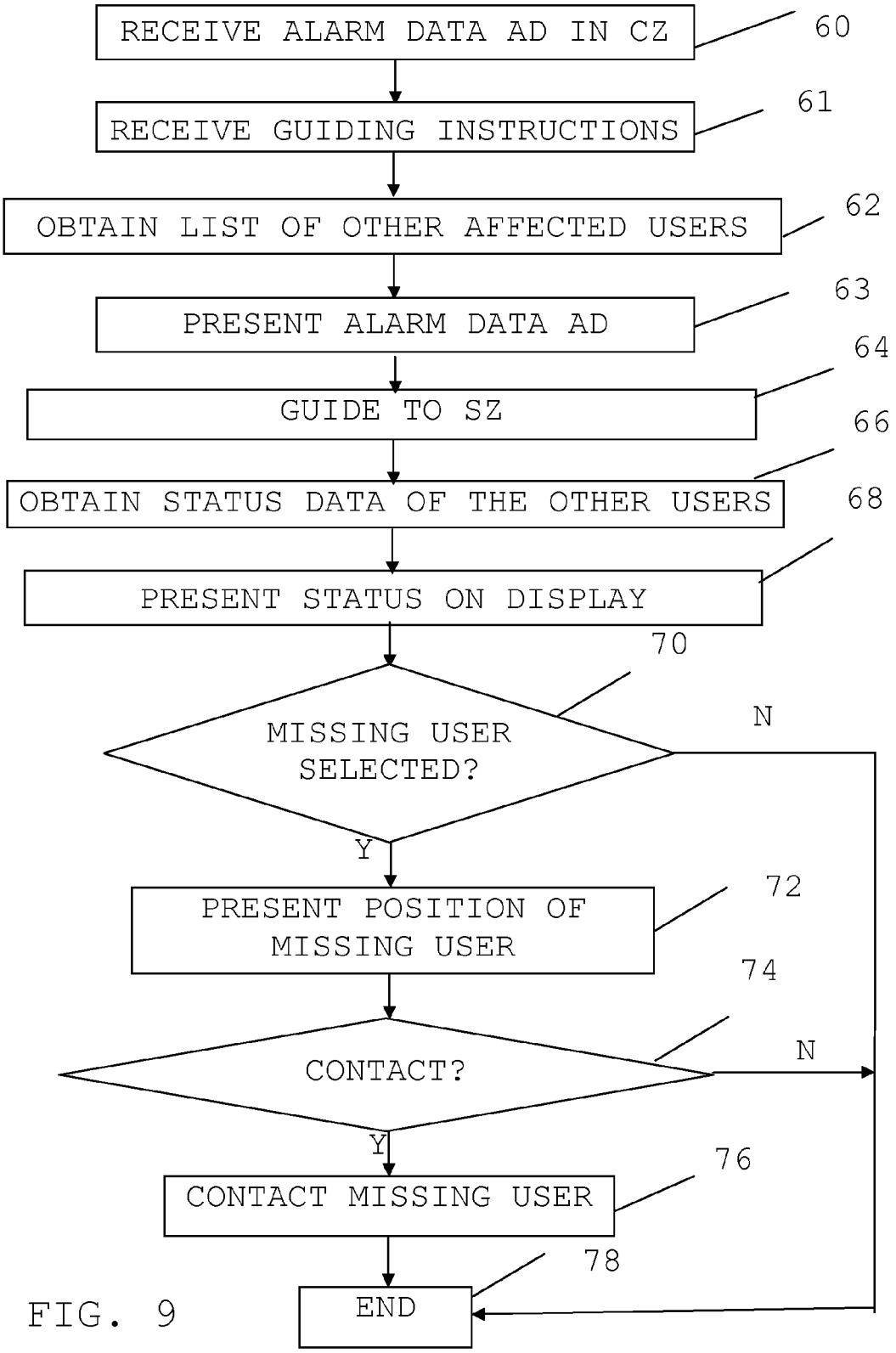
FIG. 9 shows a flow chart of a number of method steps being performed in a method of enabling users in the premises to reach safety according to a first embodiment.

A first embodiment of the invention will now be described with reference also being made to FIGS. 5-9, where FIG. 5 schematically shows a first view shown on the display of the first mobile terminal, FIG. 6 schematically shows a second view shown on the display of the first mobile terminal, FIG. 7 schematically shows a third view shown on the display of the first mobile terminal, FIG. 8 schematically shows a fourth view shown on the display of the first mobile terminal and FIG. 9 shows a flow chart of a number of method steps being performed in a method of enabling users in the premises to reach safety. In this first embodiment the sensor 24 does not need to be connected to the first wireless access point 46.

The users of the mobile terminals 32, 34, 36 and 38 may typically be plant maintenance engineers performing some activity in the premises.

In case of an emergency it is difficult for these plant engineers to get relevant information about what has happened, which may create confusion and in some extreme cases also panic among them.

Sirens can for instance confuse people. The operators may in these situations ask themselves "What kind of alarm is it, is it a drill, and is it really relevant to me?" Furthermore, even though emergency exits exist, the users do not always know how to take the shortest, quickest and most valuable exit. In case of panic the users might not take rational decisions. It is also difficult to know if there are still people left in the buildings and counting the people at the assembly areas takes time. Furthermore, if there are personnel still in the plant area, it is hard to locate them.

This invention presents a way to automatically inform personnel of an emergency situation and smoothly and quickly direct them to the closest exit. It also allows keeping track of personnel in emergency situations. The invention employs the fact that the mobile terminals have the possibility to determine the location of the holders, which is extremely useful in case of an emergency that requires the personnel to be evacuated from the plant.

In this first embodiment the guiding server 22 furthermore keeps track of the users and their positions in the plant 10. The guiding unit 41 does in this embodiment form the safety route guiding device that acts on data it receives from the guiding server 22. The guiding server 22 may keep a database including data about all plant personnel, if they are currently working and their current positions. Positions may be obtained via the wireless network WN. The positions of the mobile terminals 32, 34, 36 and 38 may more particularly be obtained through knowledge of which wireless access points 46, 48, 50 and 52 they are in contact with. A mobile terminal may in one variation be assumed to have the position of the access point with which it is connected. The signal strength of the communication between the mobile terminal and access point may be used to determine the distance of a mobile station from the access point, which gives a radius around the access point at which the mobile terminal may be located. This together with knowledge of the layout of the premises, such as where walls, floors and ceilings are provided, may be used for estimating the position. Furthermore, if a mobile terminal is in contact with more access points, then triangulation may be used. Here the points of intersection of the radiuses of two or three access points may be used for determining the position. Also this may be combined with knowledge of the layout of the premises in order to determine the position of the mobile station.

The guiding server 22 also receives alarms that are generated by the sensor 24 and field devices 26, 28 and 30. In case one of these generates an alarm which causes an emergency, then the guiding server 22 will act.

The first embodiment will now be described in more detail with the example of the premises in FIG. 4 and in relation to a first user 54 and his or her first mobile terminal 34.

The users of the mobile terminals 32, 34, 36 and 38 are here in the first room performing some activity, which is as such not really related to the invention. In this room also the sensor 24 is provided.

Imagine the following scenario: The plant is rebuilding some of its storage rooms while the process is running. Sparks from a welding job accidently enters a container filled with combustible chemicals. The chemicals burn with a high intensity and large amounts of smoke are produced. The sensor 24, which may be a smoke sensor, detects the smoke and initiates an emergency alarm. The smoke quickly fills the building 45, making visibility only a few meters.

The sensor 24 thus generates an alarm indicating an emergency. This alarm is in this first embodiment sent to the guiding server 22, which may determine the degree of the emergency. It may based on the type alarm determine the clearance zone CZ at or around the plant entity for which the alarm was generated. The plant entity may as an example be the above-mentioned container and the sensor 24 may be a sensor connected to this container for sensing of the temperature. The clearance zone CZ is in this embodiment a zone that has to be cleared, i.e. no user may be allowed to be there. The users may thus need to be guided to safety from the clearance zone SZ. The clearance zone CZ can be set as a radius around the entity causing the alarm. It may also be limited to a room, such as the first room, or a section of the building 45. In some variations of the invention, it is the whole building. The clearance zone CZ may thus always be the whole building or premises, in which case no determination of it will be needed.

After the clearance zone CZ has been determined, the guiding server 22 then determines if there are any users in the clearance zone CZ, which is done through comparing the positions of the users, or rather of their mobile terminals, with the clearance zone CZ. The guiding server 22 furthermore creates at least one list of users based on the comparison. The list is then typically made up of the users that have been determined to be inside the clearance zone. This means that the users, for which the positions of their mobile terminals are within the clearance zone CZ, are entered on the list. It is here possible that the guiding server 22 creates a single list comprising all users determined to be in the clearance zone CZ. It may as an alternative create a number of lists, one for each user determined to be in the clearance zone. Such a list may in this case exclude the user for which the list is generated. As an alternative the guiding server 22 may only provide one or a few lists for one or a few users that are being set to be responsible for evacuation. In these cases the lists may comprise all users in the clearance zone CZ. It is also possible that the user for which the list is generated is omitted from the list. There is in this way created a list for the first user 54.

The guiding server 22 may also create guiding instructions for guiding the users out of the building 45. The guiding instructions for the first user 54 may for instance be based on the location of the first mobile terminal 32 and comprise a number of instructions guiding the first user 45 from the clearance zone CZ to the security zone SZ outside of the premises. The guiding server 22 may generate and transmit such instructions to all users in the clearance zone CZ.

The guiding server 22 then transfers alarm data AD to all the field devices 32, 34, 36 and 38 in the clearance zone CZ including the first mobile terminal 34, which alarm data indicates that there is an emergency in the first room. The guiding server 22 thus informs all the personnel in the clearance zone CZ that there is an emergency situation in the plant. The guiding server 22 also transfers the guiding instructions to all the mobile stations in the clearance zone CZ including the first mobile terminal 32. The guiding server 22 finally also transfers a list to all mobile stations it has determined should receive such a list. In this example the first mobile terminal 32 receives such a list, which in this case is a list of a set of other users affected by the emergency, i.e. the users that have been determined to be in the clearance zone. The guiding server 22 transmits all this data with the help of the wireless network WN and more particularly using the first access point 46 of the wireless network WN.

The first mobile terminal 32 thus receives the alarm data AD when being in the clearance zone, where the alarm data is relevant for the first user, step 60, the guiding instructions, step 61, as well as obtains the list of other affected users, step 62, which obtaining is here done through receiving the list. All this data is here received by the radio circuit 42 via the antenna 44 and then forwarded to the guiding unit 41. It is here as an alternative possible that the guiding unit 41 itself has a set of instructions for guiding the user to the security zone SZ and then it itself determines its own position and the security zone.

As this has been done the guiding unit 41 then presents the alarm data AD for the user, step 63, see FIG. 5. This can be done through automatically setting the sound level of the mobile terminal to the maximum, emit a sound and at the same time start to vibrate. This alarm data AD may also comprise information informing the first user 54 of immediate actions needed to be performed (such as keep close to the floor in a fire, put on face protection in case of chemical explosion, etc.).

As every personnel in the concerned facility carries a mobile terminal, they may receive such alarm data AD indicating an emergency situation when they are in the clearance zone CZ. The personnel may thus read the description of the situation in the plant and take action of any advice included in the message, related to the particular emergency situation.

After this has been done the guiding unit 41 guides the first user 54 to the security zone SZ outside of the premises 45 using the received or own generated guiding data, step 64. The guiding data typically comprises instructions on how to find the closest exit out of the premises 45. The guiding instructions may provide directions, as seen in FIG. 6. These directions may furthermore be dynamically updated depending on the emergency situation as well as based on the position of the user.

Note also that in case of an emergency it is important to only display the most essential information as the personnel are most likely to be stressed. Therefore the directions may be limited to an arrow pointing to the closest exit along with the distance left.

Thus, after having looked at the alarm data, the first user 54 may make a finger gesture on the screen of the first mobile terminal 32 to open up a following next screen that provides information on how to find the nearest exit from the premises. By following the arrow indication, the first user 54 is then able to make his or her way to the nearest exit even if the visibility is severely limited by smoke. The first user 54 may thus make it out of the building and arrive safely to the security zone SZ.

It can thus be seen that the first user 54 is guided to the safe security zone SZ outside of the premises 45 and after the guiding unit 41 has determined that the security zone SZ has been reached, it informs the guiding server 22. The determining of the fact that the security zone SZ has been reached may be done through determining the position of the first mobile terminal 32 with the help of the fifth access point 52. If the mobile terminal 32 is equipped with a positioning system like Global Positioning System (GPS), then this system may also be used. If the first mobile terminal 32 is a dual mode terminal it may also notify the guiding server 22 using a mobile communication network.

By entering the security zone SZ, which may be an assembly area, the mobile terminals of the users may automatically signal that they are safe.

The server may thus receive such data from all users on the list that reach the security zone SZ. It may furthermore also receive the position information about users that have not reached the security zone SZ.

When the first mobile terminal 32 thus has informed the guiding server 22 about the first user 54 safely reaching the security zone SZ, the guiding server 22 may then send status data concerning the other users on the list. This data may be sent to all mobile terminals of the users on the list having reached the security zone SZ. The status data may comprise data indicating which users have reached safety and which have not yet done so. The positions of the users that have not reached safety are also provided. The status data may thus comprise positions of users in the set that have failed to reach the security zone SZ.

The guiding unit 41 thus receives the status data of the other users, step 66. Thereafter the status data is presented via the first mobile terminal 32, which may be done through the guiding unit 41 presenting this data on the display 34, step 68, see FIG. 7. The presentation is in this embodiment in the form of a list of names of users and indicating which users are safe and which have not reached safety, i.e. which are missing. Here the guiding unit 41 also presents a button 56 that when selected shows the positions of the corresponding missing person on a map. In this example there is one such button for each missing user.

Personnel in the security zone SZ can therefore view who has made it to safety and directly see if anyone is still left inside the facilities.

It is thus easy for personnel in the security zone SZ to keep track of the personnel that are still not listed as safe.

If then the first user 54 selects the missing user through clicking on this button 56, step 70, then the position of the missing user is presented, step 72, see FIG. 8. Also this presentation is made via the display 34 of the first mobile terminal 32. Data in the form of a Missing User Profile MUP may here be presented together with a map with an indication of the position of the missing user and an indication of the security zone SZ. The missing user profile MUP may here comprise a further button 58, for contacting the missing user, which when selected may contact the missing user through setting up a call from the first mobile terminal 32 to the mobile terminal of the missing user. If the first user 54 now selects to contact the missing user through pressing on the button 58, step 74, then the missing user is contacted, step 76, which contacting may be made through the setting of the call through the wireless network W1. However, if the terminals are dual mode terminals the contacting may also be made in a public land mobile network (PMLN). Thereafter the method is ended, step 78. If the missing user was not selected, step 70, or if a call was not selected, step 74, then the method is also ended, step 78.

The invention has a number of advantages. By knowing the location of personnel still stuck inside the building 45 the following questions can get answered: Did everyone manage to get to the security zone? If not, who is still inside the building? Where in the facilities is he or she located?

It is in this way possible to send help to missing persons. It is also possible to plot the missing persons on the map in order to send backup. It is thus possible for the guiding unit to alert rescue personnel about the position of the users having failed to reach the security zone. It will also be possible to immediately call to the people that are missing. It can in this way be seen that when an emergency is detected in the plant, instructions along with information about the accident will be automatically sent to the plant maintenance engineers. This is possible since the mobile terminals are aware of their current locations and where the exits can be found. Through providing a list and the map of missing persons it is possible to combine this with locating personnel still stuck inside the buildings with the use of mobile terminals.

Through the invention, the personnel obtain direct information about the emergency situation together with actions to take in the particular situation. Personnel are through the guidance able to make their way to the nearest exit even though the visibility may be severely limited by smoke. One can track every individual personnel in dangerous situations. Thus if someone is stuck inside the facilities, rescue personnel know where to start searching. It is possible to make direct contact to a person that is missing, either by sending a text message such as "Stay calm, rescue team on the way. Stay close to the floor." or through calling him or her.

There are several further benefits of the invention. Safety in a plant is significantly increased as maintenance personnel are warned about any danger that occurs in the plant. Safety is also increased as the personnel will be able to rely on their mobile terminals for guidance to the nearest exit. Other personnel are able to locate specific individuals by tracking the mobile terminal and help can then be sent in an effective way.

Figure 10:
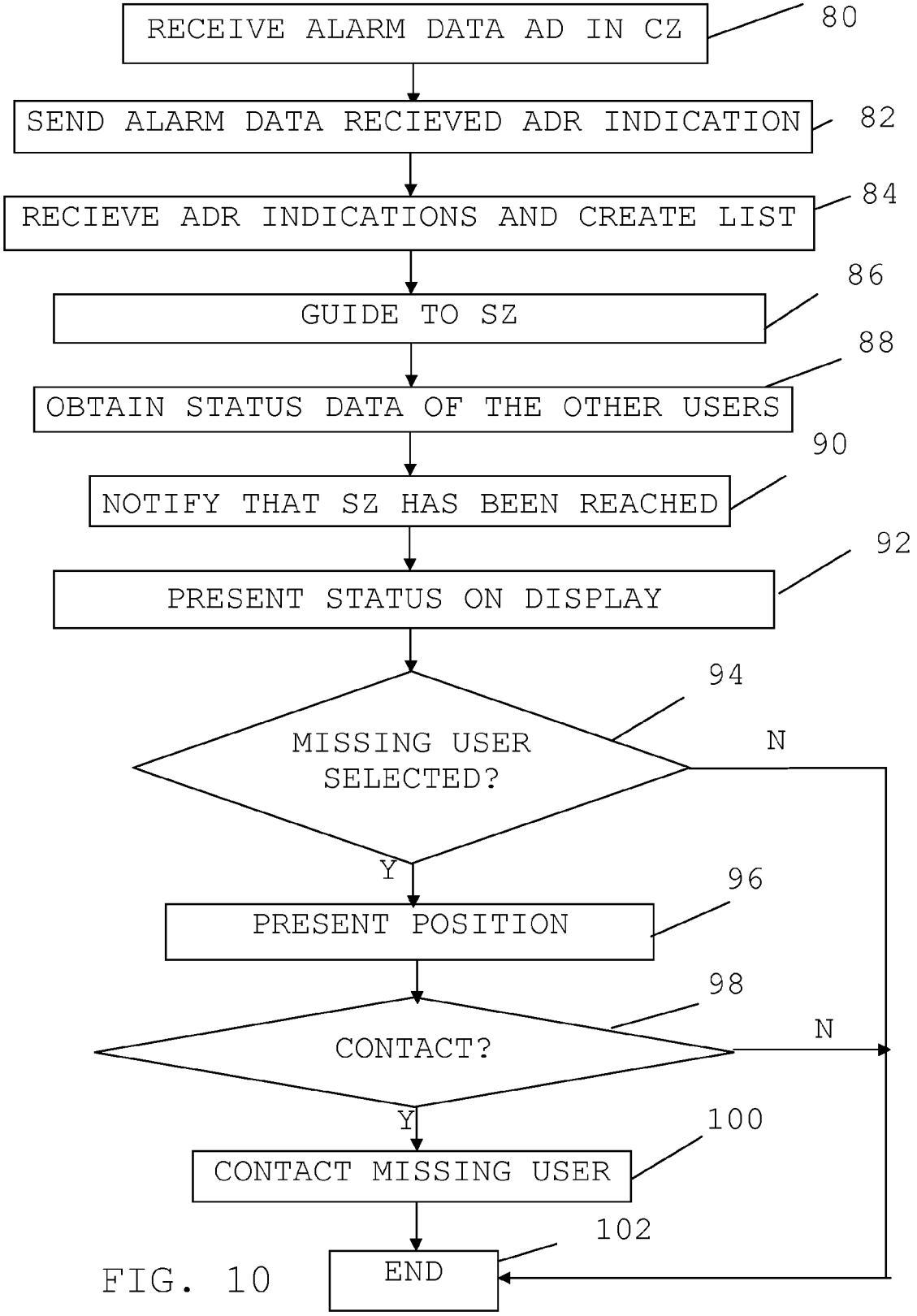
FIG. 10 shows a flow chart of a number of method steps being performed in a method of enabling users in the premises to reach safety according to a second embodiment, and FIG. 11 schematically shows a data carrier with computer program code for performing the steps of the method.

Now a second embodiment of the invention will be described with reference being made to FIG. 10 instead of FIG. 9. In this embodiment there is no guiding server 22, but the guiding unit operates on its own and thus forms a solitary safety route guiding device. In this case the guiding unit 41 may comprise information about other mobile terminals that can be at the premises, for instance all the maintenance operators of the system in FIG. 1.

In this case the same situation is assumed with an emergency occurring in the first room of the premises 45, i.e. in the room where the first wireless access point 46 is located.

The sensor 24 generates an alarm indicating an emergency. However, this alarm is in this second embodiment sent to the first wireless access point 46. The first wireless access point 46 then broadcasts alarm data AD informing of the alarm. The broadcasting is done in the clearance zone CZ, which may thus be limited to the first room. It is here also possible that the first wireless access point 46 is able to communicate with the other wireless access points 48 and 50 in the premises and make also these broadcast the alarm data in case the clearance zone CZ is larger.

This broadcast is then received in the clearance zone CZ by the guiding unit 41 of the first mobile terminal 32 via antenna 44 and radio circuit 42, step 80. The guiding unit 41 then responds with an alarm data received (ADR) indication, step 82. All mobile terminals that are able to receive the broadcast alarm data may respond with an ADR indication. The ADR indication may also comprise the identity of the mobile terminal sending it. It is here possible that the mobile terminals can detect such ADR indications sent by others in the clearance zone CZ. In this case the first mobile terminal 32 may directly detect such indications. As an alternative the first wireless access point 46 may broadcast the identities of the mobile terminals that have sent ADR indications. This may be limited to the ones with which itself is in contact. As an alternative access points in the premises may communicate with each other and share information about which mobile terminals that have sent ADR indications. They may all broadcast the identities of these mobile terminals. In this way the guiding unit 32 of the first mobile terminal 34 receives data specifying that alarm data has been received by mobile terminals of the other users that are in the clearance zone CZ, which may be obtained from the identities of the mobile terminals. Based on these identities the guiding unit 41 then forms or creates the list of other users, step 84.

As this has been done the guiding unit 41 then presents the alarm data AD for the user, see FIG. 5.

Thereafter the guiding unit 41 guides the first user 54 to the security zone SZ using guiding data stored in the guiding unit 41, step 86. The guiding data typically comprises instructions on how to find the closest exit out of the premises 45. Also in this guiding it is possible that the access point positions are used for the guiding. During the guiding the positions of the other mobile terminals in the list may also be continuously received and updated, for instance through them all sending updated positions to each other and/or to the access points, which then broadcast these positions. The guiding instructions may provide directions, as seen in FIG. 6. These directions may also here be dynamically updated depending on the emergency situation as well as based on the position of the user.

In this way the first user 54 is guided to the safety zone SZ outside of the premises 45 and after the guiding unit 41 has determined that the security zone SZ has been reached, it obtains status data of the other users in the list, step 88. It may also notify the other users in the list that it itself has reached the security zone SZ, step 90. It may communicate directly with the others that have reached the security zone SZ. This may in case the mobile terminals are dual mode terminals also be done using a mobile communication system. The status data of the missing person may be the last known position of this person. As an alternative it is possible that a request for the position is sent to fifth wireless access point 52, which in turn communicates with the other access points for them to communicate with the mobile terminal of the missing user. The mobile terminal of the missing user may then respond with position data. If both mobile terminals are dual mode terminals it is also possible that a request for the position is sent to the mobile terminal of the missing user using a mobile communication network and a response including the position received in the same way. The guiding unit may take care of this through the use of messaging such as Short Message Service (SMS) or Multimedia Messaging Service (MMS).

The guiding unit 41 of the first mobile terminal 32 thus receives the status data of the other users, step 88, and then presents this data on the display, step 92, see FIG. 7. This may also here be in the form of a list indicating which users are safe and which are missing together with the button 56.

If then the first user 54 selects the missing user through clicking on the button 56, step 94, then the position of the missing user is presented, step 96, see FIG. 8. The presentation may comprise the further button 58, which when selected contacts the missing user. If the first user 54 now selects to contact the missing user through pressing on the button 58, step 98, then the missing user is called, step 100, which call may be made in the wireless network W1 or a PMLN. Thereafter the method is ended, step 102. If the missing user was not selected, step 94 or if a call was not selected, step 98, then the method is also ended, step 102.

The guiding unit and the guiding server may, as was previously described, both be provided in the form of one or more processors together with computer program memory including computer program code for performing their functions. As an alternative they may be provided in the form of a Application Specific Integrated Circuit (ASIC) or Field-Programmable Gate Array (FPGA). This computer program code may also be provided on one or more data carriers which perform the functionality of the present invention when the program code thereon is being loaded guiding server or a mobile terminal. One such data carrier 104 with computer program code 106, in the form of a CD ROM disc, is schematically shown in FIG. 11. Such computer program may as an alternative be provided on another server and downloaded therefrom into the guiding server or the mobile terminal.

The invention claimed is:

1. A method of enabling users in the premises of an industrial plant to reach safety in case of an emergency, where said users are being equipped with mobile terminals, the method being performed by a safety route guiding device and comprising the steps of:

receiving alarm data concerning an emergency in a clearance zone of the premises, said alarm data being relevant for a user of a mobile terminal in the clearance zone;

obtaining data of a set of other users affected by the emergency, wherein the other users in the set are also in the clearance zone;

guiding the user from the clearance zone to a security zone outside the premises;

obtaining status data concerning the other users in the set comprising positions of any user(s) in the set that have failed to reach the security zone; and presenting the status data to the user via the mobile terminal with which the user is equipped, wherein the presenting via the mobile terminal with which the user is equipped further comprises presenting the position(s) of any user(s) in the set that have failed to reach the security zone.

2. The method according to claim 1, further comprising alerting rescue personnel about the position(s) of any user(s) in the set that have failed to reach the security zone.

3. The method according to claim 1, further comprising connecting to a mobile terminal of one of any user(s) in the set that have failed to reach the security zone.

4. The method according to claim 3, wherein the connecting comprises setting up a call.

5. The method according to claim 1, further comprising receiving the alarm data, the data of the set of other users and the status data from a guiding server.

6. The method according to claim 1, wherein the obtaining of data of the set of other users affected by the emergency comprises receiving data specifying that alarm data has been received by mobile terminals of the other users in the set.

7. A safety route guiding device enabling users in the premises of an industrial plant to reach safety in case of an emergency, where said users are being equipped with mobile terminals, the safety route guiding device being configured to:

receive alarm data concerning an emergency in a clearance zone of the premises, said alarm data being relevant for a user of a mobile terminal in the clearance zone;

obtain data of a set of other users affected by the emergency, wherein the other users in the set are also in the clearance zone;

guide the user from the clearance zone to a security zone outside the premises;

obtain status data concerning the other users in the set, wherein the status data comprises positions of any user(s) in the set that have failed to reach a security zone; and present the status data to the user via the mobile terminal with which the user is equipped, wherein the safety route guiding device when presenting the status data is further configured to present, via the mobile terminal with which the user is equipped, the position(s) of any user(s) in the set that have failed to reach the security zone.

8. The safety route guiding device according to claim 7, being further configured to alert rescue personnel about the position(s) of any user(s) in the set that have failed to reach the security zone.

9. The safety route guiding device according to claim 7, being further configured to connect to a mobile terminal of one of any user(s) in the set that have failed to reach the security zone.

10. The safety route guiding device according to claim 9, wherein the connecting comprises setting up a call.

11. The safety route guiding device according to claim 7, being further configured to receive the alarm data, the data of the set of other users and the status data from a guiding server.

12. The safety route guiding device according to claim 7, when being configured to obtain data of the set of other users affected by the emergency is configured to receive data specifying that alarm data has been received by mobile terminals of the other users in the set.

13. A computer program product enabling users in the premises of an industrial plant to reach safety in case of an emergency, wherein said users are being equipped with mobile terminals, said computer program product being provided on a non-transitory data carrier comprising computer program code configured to cause a safety route guiding device to, when said computer program code is loaded into the safety route guiding device, receive alarm data concerning an emergency in a clearance zone of the premises, said alarm data being relevant for a user of a mobile terminal in the clearance zone;

obtain data of a set of other users affected by the emergency, wherein the other users in the set are also in the clearance zone;

guide the user from the clearance zone to a security zone outside the premises;

obtain status data concerning the other users in the set, wherein the status data comprises positions of any user(s) in the set that have failed to reach the security zone; and present the status data to the user via the mobile terminal with which the user is equipped, wherein the presenting further comprises presenting the position(s) of any user(s) in the set that have failed to reach the security zone.

14. The method according to claim 2, further comprising connecting to a mobile terminal of one of any user(s) in the set that have failed to reach the security zone.

15. The method according to claim 2, further comprising receiving the alarm data, the data of the set of other users and the status data from a guiding server.

16. The method according to claim 3, further comprising receiving the alarm data, the data of the set of other users and the status data from a guiding server.

17. The method according to claim 4, further comprising receiving the alarm data, the data of the set of other users and the status data from a guiding server.

18. The method according to claim 2, wherein the obtaining of data of the set of other users affected by the emergency comprises receiving data specifying that alarm data has been received by mobile terminals of the other users in the set.

19. The method according to claim 3, wherein the obtaining of data of the set of other users affected by the emergency comprises receiving data specifying that alarm data has been received by mobile terminals of the other users.

20. The method according to claim 4, wherein the obtaining of data of the set of other users affected by the emergency comprises receiving data specifying that alarm data has been received by mobile terminals of the other users in the set.

* * * * *